US011285628B2

(12) United States Patent
Bunnell et al.

(10) Patent No.: US 11,285,628 B2
(45) Date of Patent: Mar. 29, 2022

(54) RAZOR CARTRIDGE CONNECTOR

(71) Applicant: Edgewell Personal Care Brands, LLC, Chesterfield, MO (US)

(72) Inventors: Jay Bunnell, Orange, CT (US); David Evarts, Stratford, CT (US); Zuky Zhang, Guangzhou (CN)

(73) Assignee: EDGEWELL PERSONAL CARE BRANDS, LLC, Chesterfield, MO (US)

( * ) Notice: Subject to any disclaimer, the term of this patent is extended or adjusted under 35 U.S.C. 154(b) by 146 days.

(21) Appl. No.: 16/641,283

(22) PCT Filed: Aug. 23, 2018

(86) PCT No.: PCT/US2018/047752
§ 371 (c)(1),
(2) Date: Feb. 24, 2020

(87) PCT Pub. No.: WO2019/046097
PCT Pub. Date: Mar. 7, 2019

(65) Prior Publication Data

US 2020/0180177 A1 Jun. 11, 2020

Related U.S. Application Data

(60) Provisional application No. 62/550,930, filed on Aug. 28, 2017.

(51) Int. Cl.
*B26B 21/22* (2006.01)
*B26B 21/52* (2006.01)

(52) U.S. Cl.
CPC ..... *B26B 21/222* (2013.01); *B26B 21/521* (2013.01)

(58) Field of Classification Search
None
See application file for complete search history.

(56) References Cited

U.S. PATENT DOCUMENTS 4,411,065 A 10/1983 Trotta
4,413,411 A 11/1983 Trotta
(Continued)

FOREIGN PATENT DOCUMENTS

WO 9836880 A1 8/1998
WO 2016061324 A1 4/2016
WO 2017210044 A1 12/2017

OTHER PUBLICATIONS

International Search Report and Written Opinion issued in connection with PCT Application No. PCT/US2018/047752 dated Nov. 28, 2018.

*Primary Examiner* — Hwei-Siu C Payer

(57) ABSTRACT

A safety razor has a handle with an extension having a pair of depressions to each receive a respective one of two detents of a razor cartridge and which extension provides cartridge support structure that engages a recess of the razor cartridge. The razor cartridge has a blade unit and a connector. The recess of the razor cartridge is in part defined by opposed walls of the connector providing a floor and a ceiling and the two detents are on the floor and extend into the recess. The floor has a slot between the two detents and the slot is sized such that deflection of any one detent on its respective floor portion is substantially independent of deflection of the other detent on its respective floor portion.

19 Claims, 7 Drawing Sheets

(56) References Cited

U.S. PATENT DOCUMENTS

| | | | | |
|---|---|---|---|---|
| 4,422,237 | A | 12/1983 | Trotta | |
| 4,446,619 | A | 5/1984 | Jacobson | |
| 4,599,793 | A | 7/1986 | Iten | |
| 4,901,437 | A | 2/1990 | Iten | |
| 5,787,586 | A | 8/1998 | Apprille, Jr. et al. | |
| 5,956,851 | A | 9/1999 | Apprille, Jr. et al. | |
| 6,026,577 | A | 2/2000 | Ferraro | |
| 7,168,173 | B2 | 1/2007 | Worrick, III | |
| 8,033,023 | B2 * | 10/2011 | Johnson | B26B 21/222 30/50 |
| 8,793,880 | B2 * | 8/2014 | Taub | B26B 21/521 30/50 |
| 9,193,077 | B2 | 11/2015 | Worrick | |
| 10,137,584 | B2 * | 11/2018 | Lee | B26B 21/14 |
| 11,052,558 | B2 * | 7/2021 | Lee | B26B 21/40 |
| 2002/0189112 | A1 | 12/2002 | Peyser | |
| 2011/0088269 | A1 * | 4/2011 | Walker, Jr | B26B 21/225 30/527 |
| 2011/0258856 | A1 * | 10/2011 | Walker | B26B 21/4031 30/50 |
| 2017/0087733 | A1 | 3/2017 | Metcalf et al. | |
| 2017/0341249 | A1 | 11/2017 | Lee et al. | |
| 2020/0180177 | A1 * | 6/2020 | Bunnell | B26B 21/521 |

* cited by examiner

RAZOR CARTRIDGE CONNECTOR

TECHNICAL FIELD

The present disclosure relates to safety razors and safety razor cartridges, and more specifically to razor cartridges that include a connector for attachment to a razor handle.

BACKGROUND

Many modern wet shaving razors, also known as safety razors, comprise a handle and a razor cartridge mounted to the handle. Some razors are so-called disposable razors wherein the handle and razor cartridge together are disposed of after use. Other razors may be in the form of a so-called system that comprises a handle that can be reused and a removable razor cartridge that is disposed of after use and can be replaced with a new cartridge.

U.S. Pat. No. 5,787,586 discloses a shaving system having a razor cartridge including a housing carrying razor blades, and a connector, also known as an interconnect member that pivotally supports the housing. A razor handle has a generally broad, flat extension providing cartridge support structure that engages a recess of the connector. The recess is in part defined by walls providing a floor and an opposed ceiling. A pair of detents are located on a cut-out cantilevered flap portion of the floor. The detents each engage one of a pair of depressions of the handle extension to snap-fittingly connect the razor cartridge to the handle.

U.S. Pat. No. 5,956,851 discloses another shaving system having a razor cartridge including a housing carrying razor blades, and a connector. A pair of latching members are located on a cut-out flap portion of the floor of this connector. The latching members each engage one of a pair of depressions of the handle extension to latchingly connect the razor cartridge to the handle.

WO-A1-2016/061324 discloses a further shaving system having a razor cartridge including a housing carrying razor blades, and a connector. A pair of asymmetrically sized and/or positioned detents are located on the floor of this connector. The detents engage a pair of depressions of the handle extension to snap-fittingly connect the razor cartridge to the handle. The detents disengage at least partially sequentially when an ejector button of the handle is operated by a user to disconnect the cartridge. In the context of the present disclosure, "partially sequentially" is intended to mean that a force/deflection (f/d) plot for disengagement of any one detent temporally overlaps the f/d plot of the other detent. "At least" is intended to mean the f/d disengagement plots can temporally overlap of be wholly sequential.

In the aforementioned documents, both of the pair of detents are located on a cut-out cantilevered flap portion of the floor of the respective connector. Movement or deflection of any one of the detents during connection/disconnection to the razor handle or actuation of an ejector button results in movement or deflection of the other of the pair of detents.

In shaving systems including those of the above documents, it is beneficial for a shaving cartridge to require a relatively low force applied by a user via an ejector button to disconnect the cartridge from the handle. Conversely, it is beneficial for a shaving cartridge to require a relatively high force to disconnect the cartridge from the handle applied during other events such as in-use or in the event of accidentally dropping the razor.

SUMMARY

The present disclosure has for its objective to eliminate, or at least substantially alleviate the limitations of the prior art by providing a safety razor, a razor cartridge of the safety razor or a connector of the razor cartridge. The safety razor comprises a handle and a razor cartridge. The handle has an extension providing cartridge support structure that engages a recess of a razor cartridge, the extension defining an axis along which the razor cartridge is moveable during connection to, and disconnection from, the extension; the extension having a pair of depressions to each receive a respective one of two detents of the razor cartridge. The handle also includes a user-operable ejector, slidable along the extension and adapted to engage the razor cartridge to disconnect the razor cartridge from the extension of the handle. The razor cartridge of the safety razor has a blade unit and a connector. The recess of the razor cartridge is in part defined by opposed walls of the connector providing a floor and a ceiling and the two detents are on the floor and extend into the recess. The floor further has a center slot between the two detents and the center slot is sized such that deflection of any one detent on its respective floor portion is substantially independent of deflection of the other detent on its respective floor portion when the user-operable ejector is operated to disconnect the razor cartridge from the extension of the handle.

In other aspects, the recess is further defined by a lateral wall and the floor has a lateral slot at or close to a junction between the floor and the lateral wall.

In further aspects, the recess is more further defined by two end walls at an end of the recess opposed an entrance of the recess, extending from the floor towards the ceiling and each end wall being adjacent a respective detent. At least one of the end walls can extend from the floor to the ceiling. Alternatively, a gap can be provided between at least one end wall and the ceiling, the gap separating the end wall and the ceiling.

In more further aspects, the detents are symmetrically sized and/or positioned about a center plane of the connector. Alternatively, the detents are asymmetrically sized and/or positioned about the center plane of the connector.

The center slot and optional lateral slot impart upon the connector that any movement or deflection of any one detent is substantially independent of any deflection of the other detent or results in no or substantially no deflection of the other detent. Engagement and disengagement of any one detent in its respective handle extension depression is substantially decoupled from engagement/disengagement of the other detent. A low force can applied by a user via an ejector button to disconnect the cartridge from the handle while a relatively higher force is required to disconnect the cartridge from the handle during other events such as in-use or in the event of accidentally dropping the razor handle.

These and other advantages of the present disclosure will be apparent to one of ordinary skill in the art in light of the following Detailed Description and Drawings.

BRIEF DESCRIPTION OF THE DRAWINGS

Reference is made to the attached drawings, wherein elements having the same reference numeral designations represent like elements throughout, and wherein.

DETAILED DESCRIPTION

Figure 2:
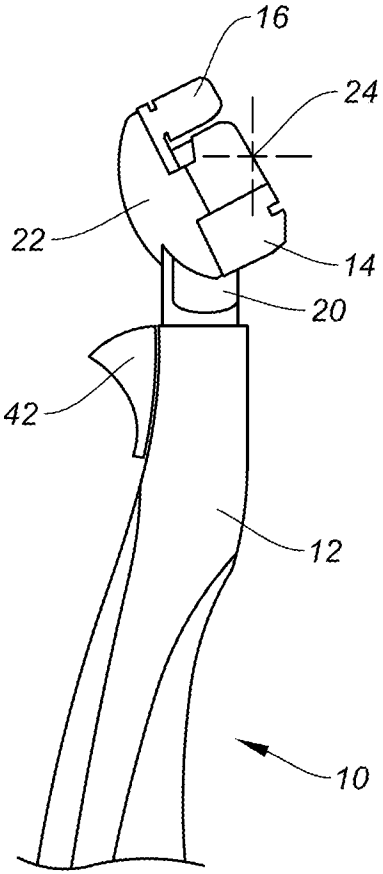
FIG. 2 is a side view of the safety razor of FIG. 1.
Figure 1:
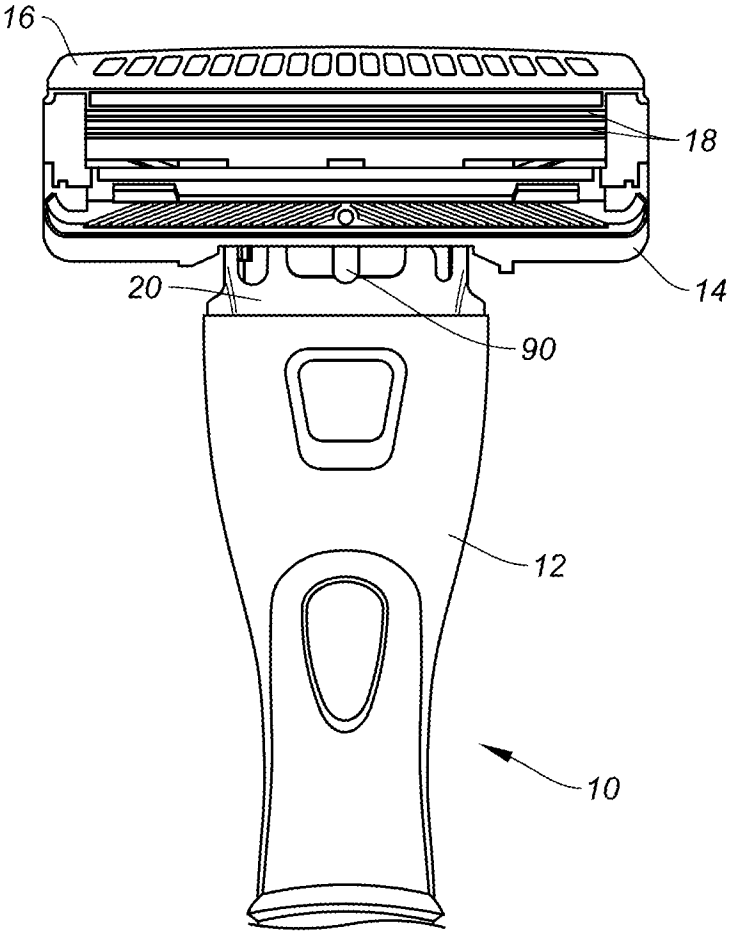
FIG. 1 is a front view of a safety razor.

Referring now to the drawings and in particular FIGS. 1-2, a safety razor 10 is depicted. The safety razor 10 comprises a handle 12 having connected thereto a razor cartridge 14. In these figures and also FIG. 3 the handle 12 is shown truncated purely for the convenience of representing these figures at a suitable scale and the present invention is not limited in regard to the length or shape of the handle 12. The razor cartridge 14 comprises a housing 16 with one or more razor blades 18 mounted within the housing 16. The housing 16 is supported by a connector 20. In the depicted embodiment the housing 16 can be pivotally supported by the connector 20 such that the housing 16 can pivot relative to the connector 20 about pivot axis 24. In the depicted embodiment the housing 16 has pivotal support structure comprising shell bearings 22 although the present disclosure should not be limited in this regard and other support methods such as pins in holes and so-called living hinges are within the scope of the present disclosure. The housing 16 can also be rigidly supported, e.g. non-pivotally supported by the connector 20 or integrally formed with the connector 20, for example as described in U.S. Pat. No. 6,026,577, the content of which relating to an integral housing (described as head 11 therein) and connector (described as chamber 15 therein) is incorporated herein for reference.

Both of the housing 16 and connector 20 are preferably made of suitable thermoplastic material(s) that can be the same or different. For example, the housing 16 can be formed from injection molded acrylonitrile butadiene styrene (ABS) and the connector can be formed from injection molded polyoxymethylene (POM). Benefits of these materials include dimensional stability, resistance to chemicals typically found in use in a wet shaving environment and low friction of one sliding relative to the other during relative pivotal motion.

Figure 3:
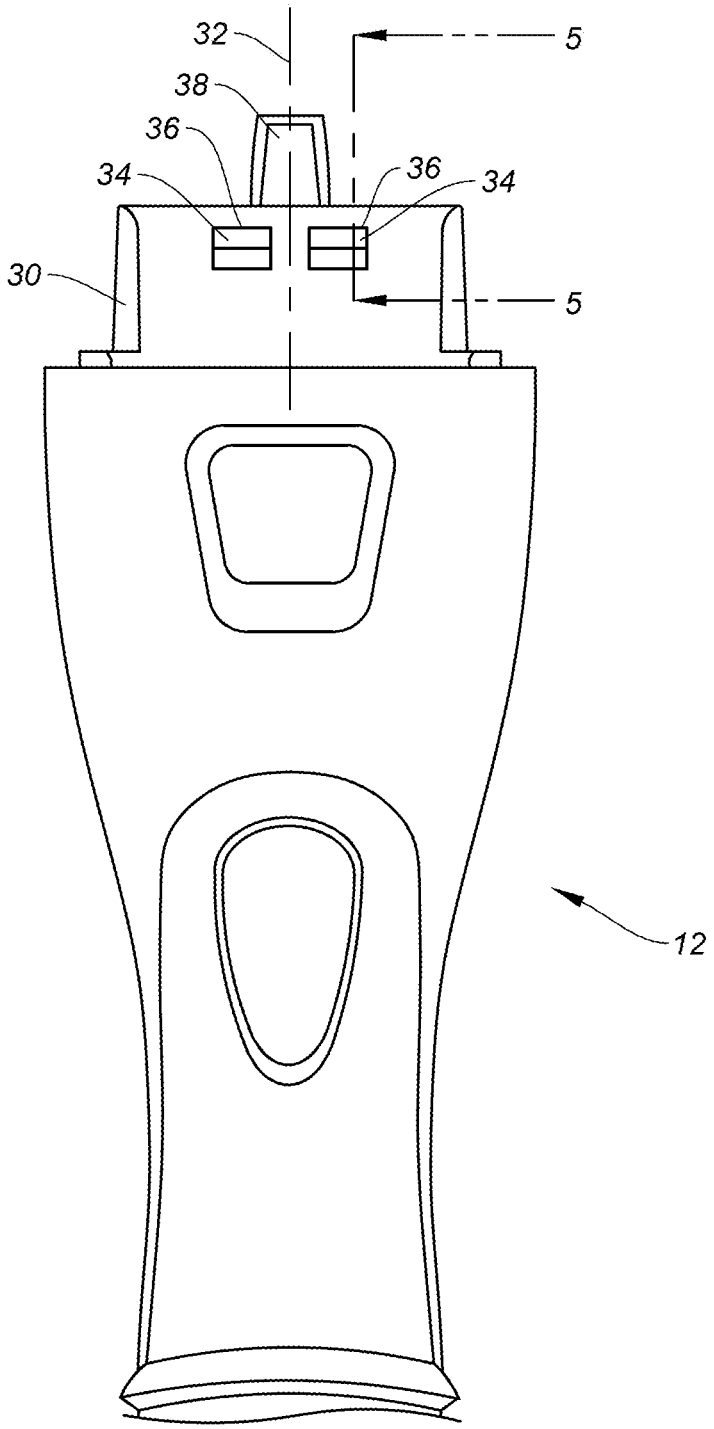
FIG. 3 is a front view of the handle of the safety razor of FIG. 1.
Figure 4:
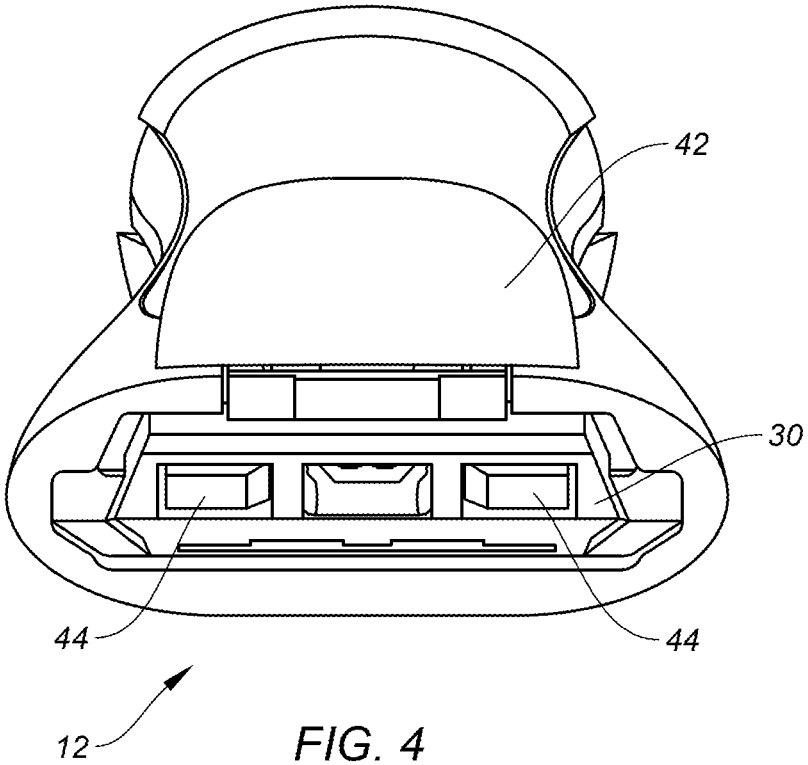
FIG. 4 is a top end view of FIG. 3.
Figure 5:
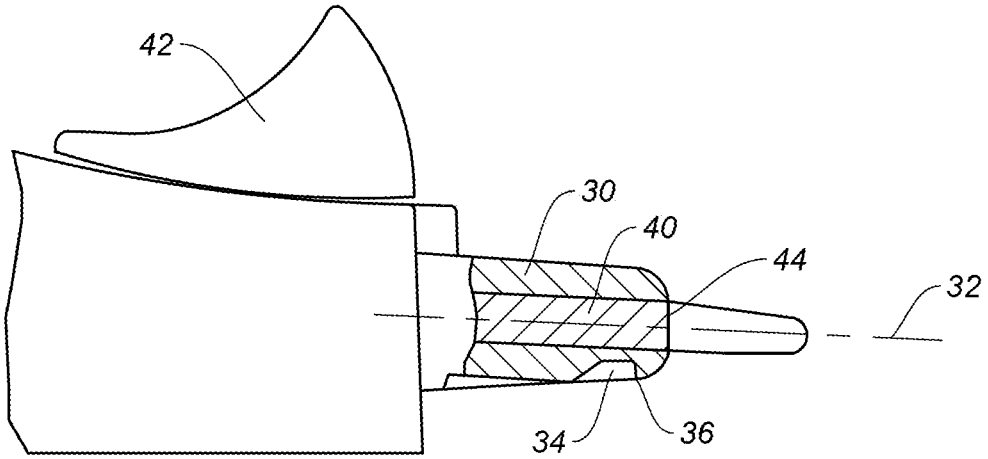
FIG. 5 is a partial sectional view of FIG. 3.

FIGS. 3-4 and 5 depict respectively a front view, a top end view and a partial sectional view of the handle 12. The handle 12 includes an extension 30 that engages a recess 50 of the connector 20 (see FIG. 6). The extension 30 defines an axis 32 along which the razor cartridge 14 moves relative to the handle when it is connect to and disconnected from the handle 12. The extension 30 includes a pair of depressions 34 that are preferably symmetrically arranged about axis 32 or can be asymmetrically sized or arranged. Both depressions 34 have a leading edge 36 as will be described later in the present disclosure. Handle 12 includes an ejector 40 that is slidable along the extension by a user operating a button 42 connected to the ejector 40. Ejector 40 can be U-shaped and distal ends 44 of each leg of the U are adapted to contact respective interior surfaces (see 52 in FIG. 6) of the connector 20 of the razor cartridge 14 when a user operates the button 42 to disconnect or otherwise eject the razor cartridge 14 from the handle 12. The handle can also be provided with a spring-biased plunger 38 which can act through an opening of the connector 20 in part defined by recess 50 (described later in the present disclosure). A distal end of the plunger 38 can act on a cam surface of the housing 16 of the razor cartridge 14 to bias the razor cartridge 14 to a neutral or at-rest position when external forces (e.g. forces encountered during a shaving operation) are removed. A typical neural position is shown in FIGS. 1 and 2.

Figure 6:
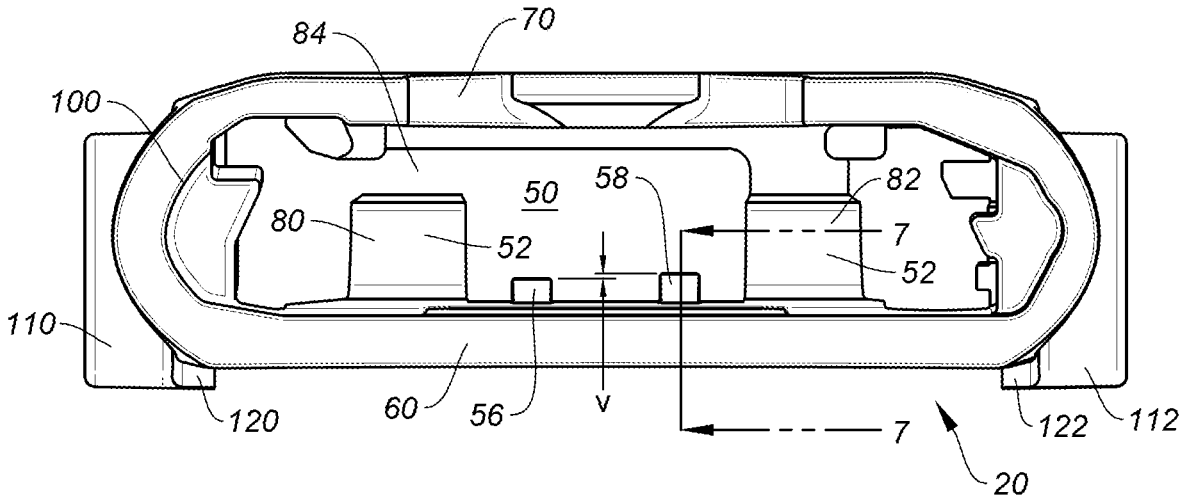
FIG. 6 is a bottom end view of the connector of the razor cartridge of the safety razor of FIG. 1.

In FIG. 6 a bottom end view of the connector 20 of the razor cartridge 14 of the safety razor 10 of FIG. 1 is depicted, i.e. a view of the entrance to the recess 50. Recess 50 is at least partially defined by opposed walls providing a floor 60 and a ceiling 70 and by end walls 80, 82 at the end of the recess 50 opposed the entrance, extending from the floor 60 towards the ceiling 70 and each end wall being adjacent a respective detent 56, 58. End walls 80, 82 define interior surfaces 52 as described in the preceding paragraph. Recess 50 includes two detents 56, 58 extending into the recess 50 from the floor 60. As depicted in FIG. 6, end wall 82 extends from the floor 60 to the ceiling 70 and connects the floor 60 to the ceiling 70. End wall 80 extends from the floor 60 and a gap 84 is provided between the top of this end wall 80 and ceiling 70 separating this end wall 80 from the ceiling 70. In other embodiments gaps 84 can be provided between both end walls 80, 82 and the ceiling 70. Alternatively, both end walls 80, 82 can extend from the floor 60 to the ceiling 70.

In FIGS. 8-12, another connector 20' is depicted also having features as described above. This connector has opposed floor and ceiling walls (60', 70' respectively) partially defining a recess 50'. Detents 56', 58' extend from the floor 60'. End walls 80', 82' extend from the floor 60' towards the ceiling 70'. End wall 82' interconnects floor 60' and ceiling 70'. A gap 84' is provided between the top of end wall 80' and the ceiling 70'. Opposed arcuate bearing structures 110', 112' are provided that engage respective shell bearings 22 of housing 16 to provide pivotal movement of housing 16 relative to connector 20' about pivot axis 24. Arcuate bearing structures 110', 112' are at the distal end of arms 120', 122'.

Floor 60' includes a center slot 90' positioned between detents 56', 58'. An optional lateral slot 92 is positioned on the opposed side of detent 56' at or close to a junction between the floor 60' and a respective lateral wall 100' of the recess 50'. Preferably the lateral slot 92 is in the floor 60'. Both of center slot 90' and lateral slot 92 preferably extend through or substantially through the floor 60'. Both of center slot 90' and lateral slot 92 are sized (i.e. have a length in a direction parallel to axis 32) such that any movement or deflection of any one detent 56', 58' is substantially independent of any deflection of the other detent 58', 56' or results in no or substantially no deflection of the other detent 58', 56'. Engagement and disengagement of any one detent 56', 58' in its respective handle extension depression 34 is substantially decoupled from engagement/disengagement of the other detent 58', 56'. A low force can applied by a user via an ejector button to disconnect the cartridge from the handle while a relatively higher force is required to disconnect the cartridge from the handle during other events such as in-use or in the event of accidentally dropping the razor.

As depicted in the embodiment of FIGS. 8-12 (and also FIG. 6), a gap 84, 84' is provided between end wall 80, 80' and ceiling 70, 70'. In conjunction with center slot 90' and lateral slot 92, detent 56' together with its local portion of floor 60' and end wall 80' acts as a unitary latching member when ejector leg distal end 44 acts on respective interior surface 52' as a result of a user operating button 42 of handle 12 to eject the cartridge 14 from the handle. In this embodiment end wall 82' interconnects floor 60' to ceiling 70' at or close to detent 58'. Detent 58' with its local portion of floor 60' acts as a unitary snap fit in its respective depression 34 when ejector leg distal end 44 acts on respective interior surface 52' as a result of a user operating button 42 of handle 12 to eject the cartridge 14 from the handle. In other words, one detent (e.g. 56') can act as a part of a unitary latching member independently of the other detent (e.g. 58') acting as a part of a unitary snap fit.

Figure 7:
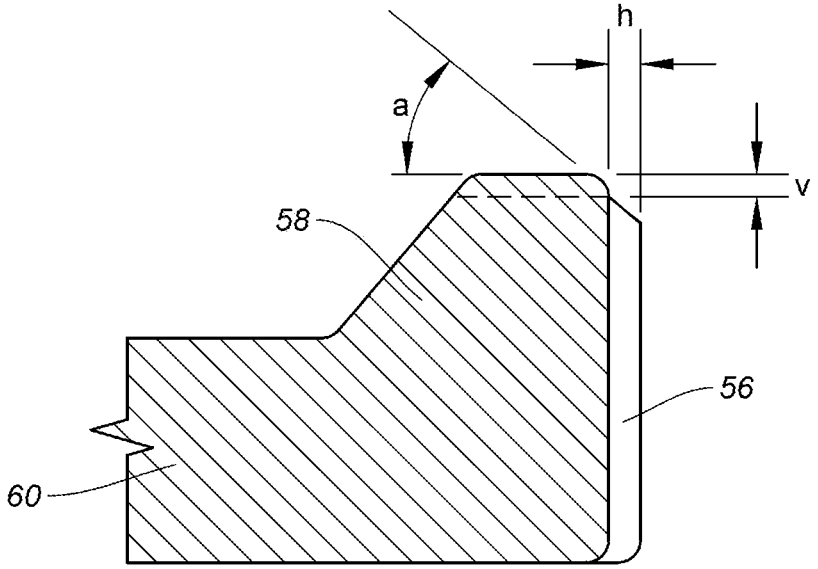
FIG. 7 is a side view of FIG. 6.
Figure 8:
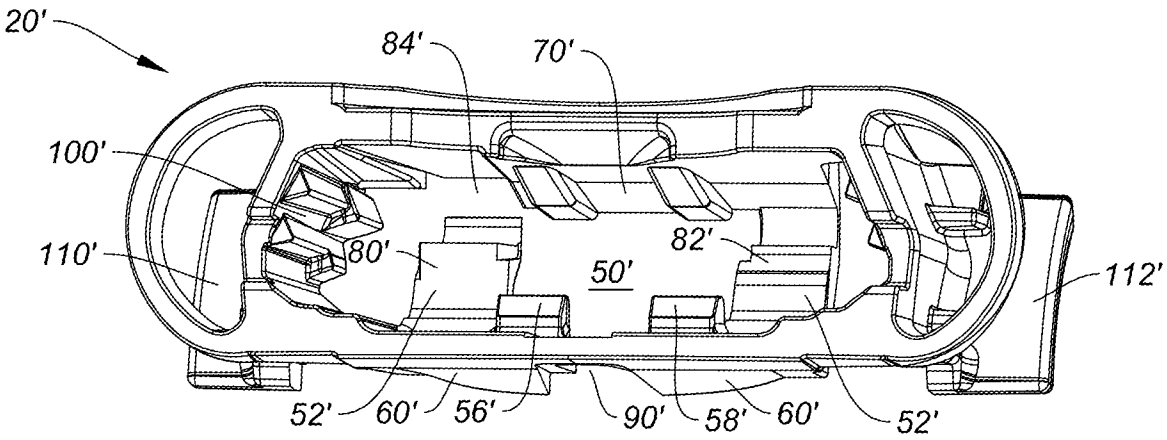
FIG. 8 is a lower perspective view of another connector.
Figure 9:
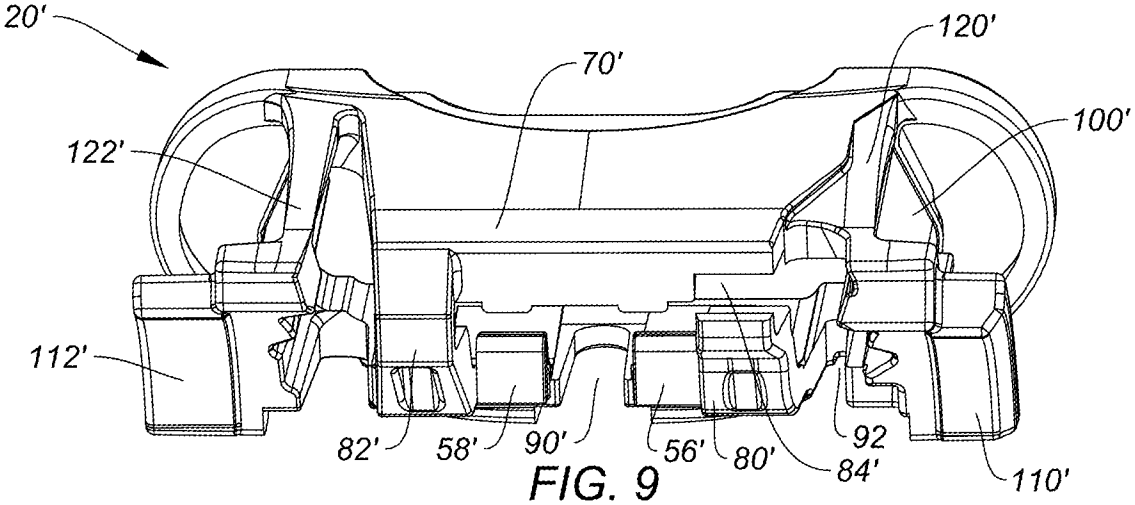
FIG. 9 is an upper perspective view of the connector of FIG. 8.
Figure 10:
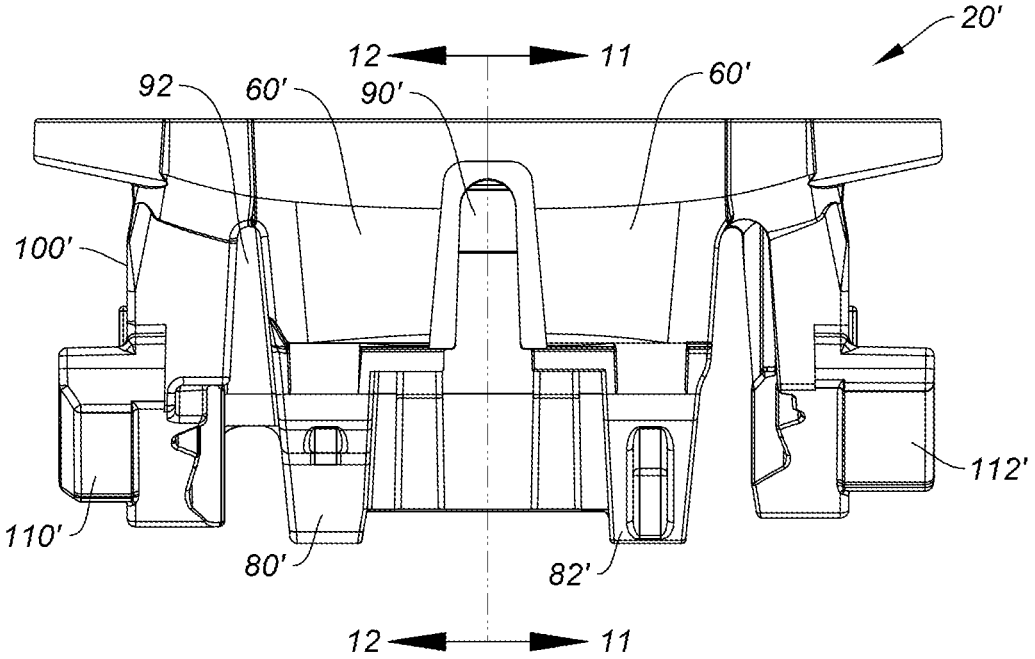
FIG. 10 is a bottom plan view of the connector of FIG. 8.
Figure 11:
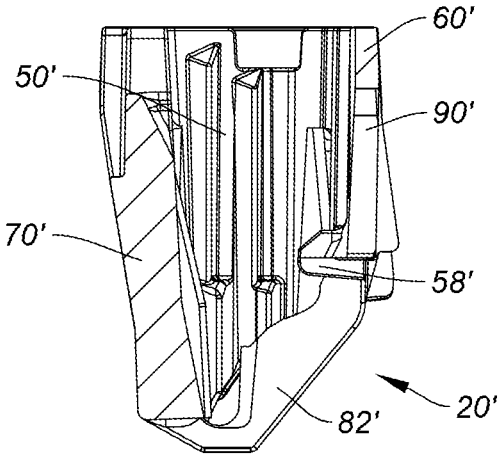
FIG. 11 is a sectional view of FIG. 10 taken at 11-11.
Figure 12:
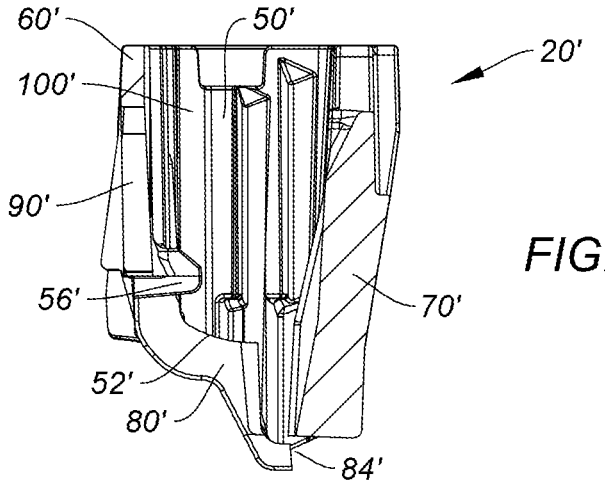
FIG. 12 is an opposed sectional view of FIG. 10 taken at 12-12.

In FIGS. 8-12, detents 56', 58' can be generally symmetrical sized and positioned (about a center plane of connector 20' through section cutting plane 11-11/12-12). In FIG. 6 detents 56, 58 (as depicted) can have a different height "v" defined in a direction normal to the floor 60 (see also FIG. 7). In FIG. 7, a partial sectional view of FIG. 6, the leading edge (right hand side as depicted) of detent 56 can be offset relative to the leading edge of detent 58 by a distance "h" or one detent 56 or 58 can be provided with a different lead-in angle "a." During disconnection of the cartridge 14 from the handle 12 detent 56 engages the leading edge 36 of its respective depression 34 independently of the engagement between detent 58 engaging the leading edge 36 of its respective depression 34. In this manner the engagement/disengagement of any one detent 56, 58 can be entirely independent in terms of timing (e.g. any one can begin to disengage before the other), force/deflection characteristics and action (snap fit or as a latching member arrangement) to the other detent 58, 56.

Those skilled in the art will recognize that variations and modifications can be made without departing from the true scope of the disclosure as defined by the claims that follow. For example, the depressions can be provided in an interior wall of the recess and the detents provided on the outer surface(s) of the extension. The detents can be symmetrically arranged about the axis and the depressions can be asymmetric relative to the axis. Features disclosed in connection with any one embodiment can be used alone or in combination with each feature of the respective other embodiments.

What is claimed is:

1. A safety razor, comprising:

a handle having an extension providing cartridge support structure that engages a recess of a razor cartridge, the extension defining an axis along which the razor cartridge is moveable during connection to, and disconnection from, the extension; the extension having a pair of depressions to each receive a respective one of two detents of the razor cartridge;

the handle including a user-operable ejector, slidable along the extension and adapted to engage the razor cartridge to disconnect the razor cartridge from the extension of the handle; and the razor cartridge comprising a blade unit and a connector;

wherein the recess of the razor cartridge is in part defined by opposed walls of the connector providing a floor and a ceiling and the two detents are on the floor and extend into the recess;

wherein the floor further has a center slot between the two detents and the center slot is sized such that deflection of any one of the two detents on its respective floor portion of the floor is substantially independent of deflection of the other detent on its respective floor portion of the floor when the user-operable ejector is operated to disconnect the razor cartridge from the extension of the handle.

2. The safety razor of claim 1, wherein the recess is further defined by a lateral wall and the floor has a lateral slot at or close to a junction between the floor and the lateral wall.

3. The safety razor of claim 1, wherein the recess is further defined by two end walls at an end of the recess opposed an entrance of the recess, extending from the floor towards the ceiling and each of the end walls being adjacent a respective one of the detents.

4. The safety razor of claim 3, wherein at least one of the end walls extends from the floor to the ceiling.

5. The safety razor of claim 3, wherein a gap is provided between at least one of the end walls and the ceiling, the gap separating the at least one end wall and the ceiling.

6. The safety razor of claim 1, wherein the detents are one of symmetrically sized and positioned about a center plane of the connector.

7. The safety razor of claim 1, wherein the detents are one of asymmetrically sized and positioned about a center plane of the connector.

8. A razor cartridge comprising a blade unit and a connector;

the connector having a recess in part defined by opposed walls of the connector providing a floor and a ceiling and two detents extend from the floor into the recess;

wherein the floor further has a center slot between the two detents and the center slot is sized such that deflection of any one of the two detents on its respective floor portion of the floor is substantially independent of deflection of the other detent on its respective floor portion of the floor when a force is applied to deflect any one of the two detents.

9. The razor cartridge of claim 8, wherein the recess is further defined by a lateral wall and the floor has a lateral slot at or close to a junction between the floor and the lateral wall.

10. The razor cartridge of claim 8, wherein the recess is further defined by two end walls at an end of the recess opposed an entrance of the recess, extending from the floor towards the ceiling and each of the end walls being adjacent a respective one of the detents.

11. The razor cartridge of claim 10, wherein at least one of the end walls extends from the floor to the ceiling.

12. The razor cartridge of claim 10, wherein a gap is provided between at least one of the end walls and the ceiling.

13. The razor cartridge of claim 8, wherein the detents are one of symmetrically sized and positioned about a center plane of the connector.

14. A connector for a razor cartridge;

the connector having a recess in part defined by opposed walls of the connector providing a floor and a ceiling and two detents extend from the floor into the recess;

wherein the floor further has a center slot between the two detents and the center slot is sized such that deflection of any one of the two detents on its respective floor portion of the floor is substantially independent of deflection of the other detent on its respective floor portion of the floor when a force is applied to deflect any one of the two detents.

15. The connector of claim 14, wherein the recess is further defined by a lateral wall and the floor has a lateral slot at or close to a junction between the floor and the lateral wall.

16. The connector of claim 14, wherein the recess is further defined by two end walls at an end of the recess opposed an entrance of the recess, extending from the floor towards the ceiling and each of the end walls being adjacent a respective one of the detents.

17. The connector of claim 16, wherein at least one of the end walls extends from the floor to the ceiling.

18. The connector of claim 16, wherein a gap is provided between at least one of the end walls and the ceiling.

19. The connector of claim 14, wherein the detents are one of symmetrically sized and positioned about a center plane of the connector.

* * * * *